United States Patent [19]

Ziegler

[11] Patent Number: 4,976,492

[45] Date of Patent: Dec. 11, 1990

[54] FOLDABLE OUTDOOR CHAIR

[75] Inventor: Sidney Ziegler, Mongaup Valley, N.Y.

[73] Assignee: Budoff Outdoor Furniture, Inc., Monticello, N.Y.

[21] Appl. No.: 399,217

[22] Filed: Aug. 28, 1989

[51] Int. Cl.[5] ..... A47C 4/08

[52] U.S. Cl. ..... 297/31; 297/39

[58] Field of Search ..... 297/31, 39, 40, 53, 297/35, 16

[56] References Cited

U.S. PATENT DOCUMENTS

| | | | |
|---|---|---|---|
| 2,222,296 | 11/1940 | Luiken | 297/31 |
| 4,635,998 | 1/1987 | Hickey | 297/39 X |

FOREIGN PATENT DOCUMENTS

| | | | |
|---|---|---|---|
| 1089750 | 11/1980 | Canada | 297/39 |
| 1284060 | 1/1962 | France | 297/31 |

*Primary Examiner*—Peter R. Brown

*Attorney, Agent, or Firm*—Curtis, Morris & Safford

[57] ABSTRACT

A foldable outdoor chair movable from a position of use to a collapsed position is provided. The chair has a combined seat bottom and rear leg assembly including a seat bottom and laterally spaced side rails, a seat back assembly including a seat back, a front leg assembly including a pair of laterally-spaced front legs, and a pair of arm rests. The outdoor chair also includes a lever assembly to facilitate folding which includes a pair of levers. Each lever is pivotally connected at a first pivot point to the seat back assembly below the seat bottom and is also pivotally connected at a second pivot point to one of the side rails below the center axis of the side rail. The chair is foldable when an upward force is applied to the seat back assembly to disengage the seat back from the side rails and subsequently a forward force is applied to the seat back such that a clockwise rotation is imparted to the first pivot point whereby the chair is moved to an intermediate position. The chair is then moved to its collapsed position when a downward force is applied to the seat back such that the levers are pivoted counterclockwise causing the seat bottom and leg assembly, seat back assembly, front leg assembly and pair of arm rests to be in a substantially horizontal orientation generally parallel to one another.

19 Claims, 2 Drawing Sheets

FIG. 1
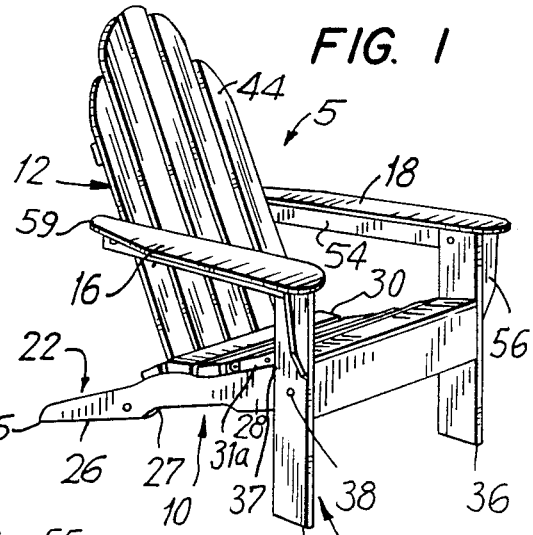
FIG. 2
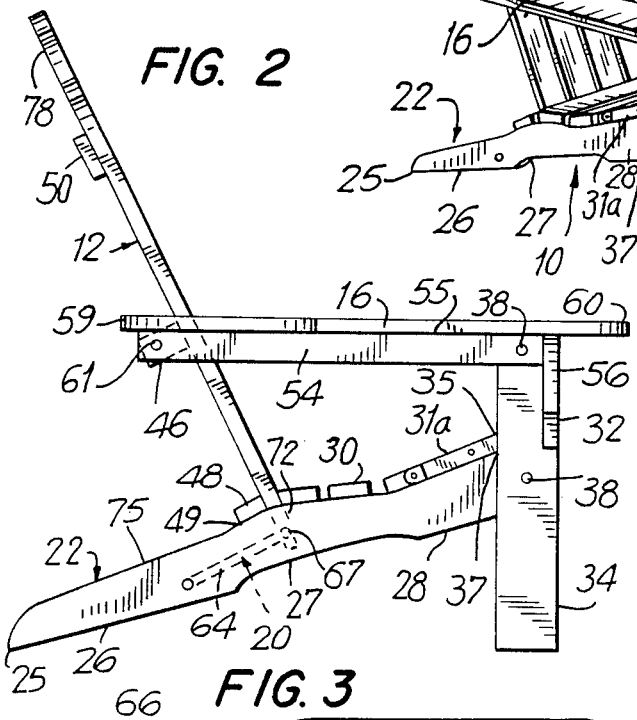
FIG. 3
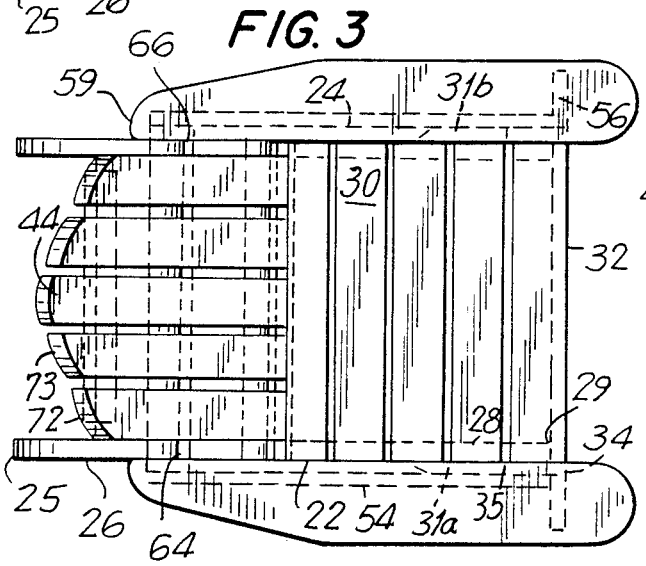
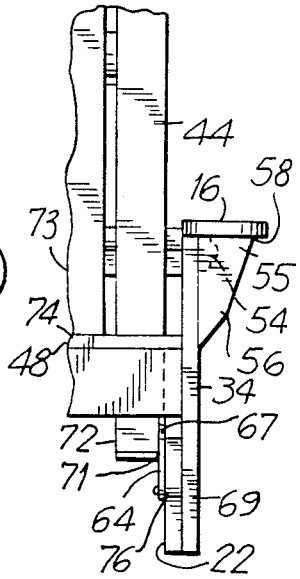
FIG. 4

FOLDABLE OUTDOOR CHAIR

BACKGROUND OF THE INVENTION

This invention relates to the field of chairs, and more particularly, to an outdoor chair which is foldable between an open, used position and a collapsed, stored position.

In order to store or transport furniture to be used outdoors, it is desirable that such furniture be foldable between an open, usable position and a collapsed, stored position. In the prior art, various structures have been developed so that a chair is capable of being foldable from a position of use to a collapsed position. Representative of such a foldable chair is the chair described in U.S. Pat. No. 4,635,998 issued Jan. 13, 1987 to Hickey. In the Hickey chair, a hinge is pivoted at one end to a side rail and at its opposite end to a cross-piece located at the bottom of the chair back. When in the open, or locked, position, the cross-piece rests on the side rails. However, any forward movement of the Hickey chair back, as when one rises from the chair or pushes it from behind, will cause the chair back to move forward and collapse the chair. To prevent this, pins are inserted through holes in the front legs to mate with matching holes provided in the front of the side rails.

In Hickey, if these locking pins are not in place, the chair will collapse when an individual slides forward to get out of the chair, places his hands in the natural position on the armrests to rise from the chair, and thus puts pressure on the armrests forward of the points at which the armrests are connected to the front legs. Without the locking pins in place, the Hickey chair will also collapse if an individual pushes or pulls the top of the seat back forward. In these instances, the Hickey chair back has a tendency to rise upwardly and the pivot pin thus moves upwardly and rearwardly such that the Hickey chair folds into its collapsed condition. Collapse of the Hickey chair is attributed primarily to the face that the forward pivot point of the lever assembly is aligned with or above the last slat on the seat bottom. The locking pins thus are necessary to lock and retain the Hickey chair in its open position of use. These pins, however, are easily lost and, moreover, result in a very unsteady chair which wobbles even when in the open, locked position.

OBJECTS OF THE INVENTION

It is a general object of the invention to provide an improved foldable outdoor chair.

It is also an object of the invention to provide an improved foldable outdoor chair which provides smooth folding of the chair.

It is a further object of the invention to provide an improved foldable outdoor chair which provides for stable, firm locking of the chair.

It is another object of this invention to provide an improved foldable outdoor chair which obviates the need for pins being inserted through holes in the front legs which mate with matching holes provided in the front of the side rails.

Other objects and advantages of the invention will become apparent from the following detailed description and from the appended drawings in which like numbers have been used to designate like parts in the several views.

SUMMARY OF THE INVENTION

This invention relates to a foldable outdoor chair which is adapted to be pivoted from a position of use to a collapsed position. The foldable chair includes a combined seat bottom and rear leg assembly, a seat back assembly, a front leg assembly, a pair of arm rests, and a lever assembly to facilitate folding.

The combined seat bottom and rear leg assembly includes laterally spaced side rails having front seat bottom portions and rear leg portions. A plurality of transverse slats connect the front seat bottom portions of the side rails to form the seat bottom. A first transverse load bearing member connects the front ends of the front seat bottom portions of the side rails in order to retain the side rails in a generally parallel orientation with respect to one another. Additionally, a pair of abutment members are provided, one on each side of the seat bottom.

The front leg assembly includes a pair of laterally spaced front legs which are pivotally secured near their midpoints to the front ends of the seat bottom portions of the side rails. The rear surface of each front leg abuts against the front surface of the seat bottom abutment member to restrain further rearward movement of each front leg in the open, use position of the chair. The front legs also include a curved camming surface at a top corner thereof which aids the arm rest in pivoting with respect to the front legs to bring the chair to its closed, stored position.

The seat back assembly includes a plurality of longitudinal slats which form a seat back which are connected near their upper end by an upper transverse bar and are connected near their mid points by an intermediate transverse bar and are connected near their lower ends by a lower transverse bar. These transverse bars provide support for the seat back when an individual sits in the chair. Furthermore, the lower transverse bar rests against the top surface of the side rails in the open, use position of the chair to provide additional horizontal and vertical support to the seat back assembly.

Each arm rest has an elongated rib secured to the underside thereof which extends lengthwise thereof from a point near the rear end of the arm rest to a point short of the front end. Each front leg has a transverse plate at the upper end thereof capable of abutting engagement with the underside of the front portion of the arm rest to provide additional support for each arm rest. The rear end of the elongated rib of each arm rest is pivotally secured to the intermediate transverse bar of the seat back assembly and the front ends of the longitudinal ribs are pivotally secured to the upper ends of the respective front legs.

The lever assembly includes a pair of levers which are pivotally connected at a first pivot point to the seat back assembly below the seat bottom and are also pivotably connected at a second pivot point to one of the side rails below the center thereof.

In order to collapse the chair, the operator places his foot on the upper surface of one of the side rails while lifting the seat back assembly upwardly. In this position, each lever pivots about its first pivot point such that the front legs are pivoted forwardly with respect to the seat bottom and the elongated ribs of the arm rests. Further pivoting about the first pivot point continues until the front legs are pivoted generally parallel to the side rails and the front face of the seat back abuts against the rear surface of the last transverse slat forming the seat bottom. In order to move the chair to its fully collapsed position, a downward force is applied to the rear face of the seat back causing the lever to pivot about its second pivot point such that the seat back, arm rest, side rails and front legs all are substantially horizontal and parallel to one another in the collapsed position.

BRIEF DESCRIPTION OF THE DRAWINGS

The following detailed description, given by way of example but not intended to limit the invention solely to the specific embodiments described, may best be understood in conjunction with the drawings in which:

FIG. 1 is a front perspective view of a preferred embodiment of the foldable outdoor chair of this invention as shown in its posit use.

FIG. 2 is a side elevational view of the foldable outdoor chair of FIG. 1 with the lever 64 in cross-section.

FIG. 3 is a top plan view of the foldable outdoor chair of FIG. 1.

FIG. 4 is an enlarged fragmentary rear elevational view of the foldable outdoor chair of FIG. 1 specifically illustrating the of lever 64.

DETAILED DESCRIPTION OF THE PREFERRED EMBODIMENT

Figure 5:
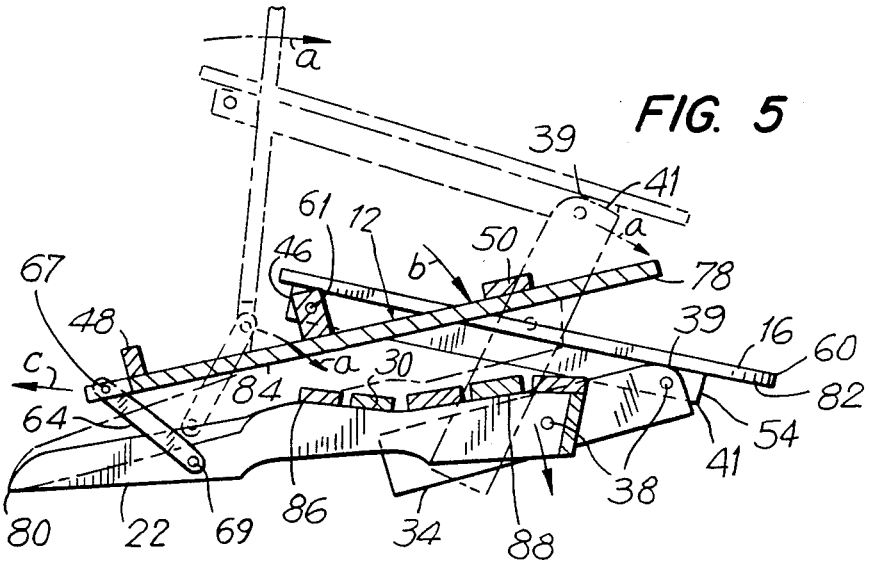
FIG. 5 is a side elevational view showing the outdoor foldable chair of FIG. 1 in its partially folded position in broken lines, and showing the chair folded further towards its collapsed position solid lines.

Referring now to FIG. 1, a foldable outdoor chair 5 is illustrated having a combined seat bottom and leg assembly 10, a seat back assembly 12, a front leg assembly 14, a pair of arm rests 16 and 18, and a lever assembly 20 (see FIG. 2). This outdoor chair is adapted to be foldable between an open position of use (FIG. 1) and a collapsed position (FIG. 6) which permits the outdoor chair to be easily stored and transported.

The combined seat bottom and rear leg assembly 10 includes a pair of laterally spaced parallel side rails 22 and 24 which are in the form of flat board-like members. When the chair is supported on a horizontal surface in its position of use as shown in FIGS. 1 and 2, the side rails are disposed in a generally vertical plane and are inclined downwardly from the front ends to the rear ends where they contact the supporting surface. The rear leg portions 26 of the rails extend from the rear ends 25 to about the mid-point 27 of the rails and the front seat bottom portions 28 of the side rails extend from about the mid-point to the front ends 29 of the rails.

As shown in FIGS. 1–3, a plurality of spaced-apart transverse slats 30 are secured to the upper edges of the front seat bottom portions 28 of the rails to connect the rails together and to form the seat bottom. Additionally, in order to retain the side rails in a generally parallel orientation with respect to one another, a transverse load-bearing member 32 extends across the front of the seat bottom and connects the front ends 29 of the front seat bottom portions 28 of the side rails to retain the side rails in a generally parallel orientation with respect to one another. This transverse loadbearing member 32 is a flat plate like member which is disposed in a generally vertical plane when the chair is supported on a horizontal surface in its position of use (see FIGS. 1 and 2). Additionally, a pair of abutment members 31*a* and *b* are provided, each one extending horizontally from a side edge of the seat bottom transverse slats 30. The forward surface 35 of each of these abutment members abuts against and restrains the front leg assembly from further rearward movement in the open, use position of the chair and supports the front legs in a generally vertical position in the open, use position.

The front leg assembly 14 includes a pair of laterally spaced parallel front legs 34 and 36 which are disposed in a generally vertical plane when the chair is supported on a horizontal surface in its position of use (see FIGS. 1 and 2). Fasteners 38 pivotally connect the front legs near the mid-point of their lengths to the front ends 29 of the seat bottom portion 28 of the side rails 22 and 24. These fasteners 38 extend transversely of the chair and are disposed on a common horizontal axis. As aforementioned, the rear surface 37 of the front legs abut against the corresponding seat bottom abutment member 31*a* and *b* to restrain further rearward movement of the front legs in the open, use position. The front legs 34 and 36 also include a curved camming surface 39 (see FIGS. 5 and 6) at the top corner 41 thereof which aids each arm rest in pivoting with respect to the front legs to bring the chair to its closed, stored position.

The seat back assembly 12 includes a plurality of laterally spaced longitudinal slats 44 connected near the midpoint by an intermediate transverse bar 46. The longitudinal slats are also connected near their lower ends by a lower transverse bar 48 and near their upper ends by an upper transverse bar 50. These bars provide for additional support for the seat back assembly when an individual's back rests thereagainst during use Furthermore, the lower transverse bar 48 rests against the top surface 49 of the side rails in the open, use position of the chair to provide additional horizontal and vertical support to the seat back assembly.

The arm rests 16 and 18 are in the form of elongated flat board-like members which extend parallel to one another and, in the position of use extend generally horizontal or perhaps with a slight downward and rearward slope. An elongated rib 54 extends lengthwise of each arm rest, being secured to the undersurface 55 thereof. Each leg 34 and 36 has a laterally outwardly extending plate or rib 56 secured to the upper end portion thereof and the top edge 58 thereof abuts against the bottom surface 55 of the arm rest to stabilize the chair when it is in the upright position of use and provides additional support to the arm rests in the open, use position.

The rear ends 59 of each arm rest are pivoted with respect to the seat back assembly 12 by means of aligned transverse fasteners 61 connecting each rib 54 to the ends of the intermediate transverse bar 46. As aforementioned, the front ends 60 of the arm rest are pivotally secured to the front leg assembly by means of aligned transverse fasteners 38 connecting the upper ends of the legs 34 and 36 to the front ends of the rib 54 of the arm rests.

Figure 6:
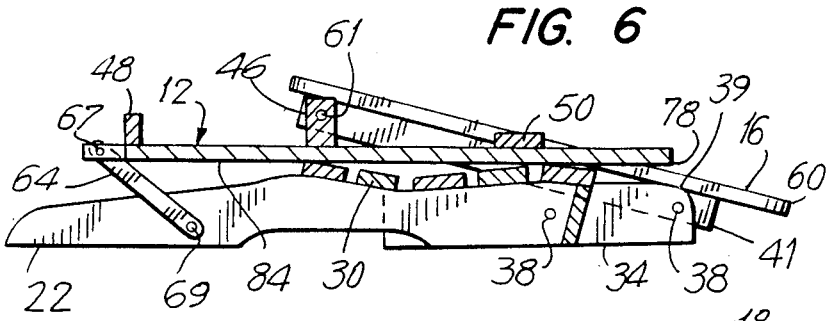
FIG. 6 is a side elevation view of the foldable outdoor chair of FIG. 1 illustrating the chair in its fully collapsed position.

As best shown in FIGS. 4–6, the lever assembly 20 includes a pair of parallel levers or hinges 64 and 66. Each lever is pivoted at 67 below the corresponding lower transverse bar or cross-piece 48 and provides for a first pivot point of the lever. The pivot point 67 connects the lever to an exterior side surface 71 of an outer slat member 72 which is longer than the central slat members 73 the bottom edges 74 of which are generally aligned with the seat bottom in the horizontal position of the chair. The outer slat members 72 extend below the seat bottom in the chair use position (see FIGS. 2 and 4). In the preferred embodiment, when the chair is in the open, locked position, pivot connection 67 is approximately one-half inch or more below the lower transverse bar 48 which is generally aligned with the transverse slats forming the seat bottom in the open, use position of the chair. This provides for smooth folding, and stable locking of the outdoor chair. Moreover, the opposite end of each lever or hinge is pivoted at 69 below the center axis of one of the side rails and provides for a second pivot point of the lever. This second pivot point 69 connects each lever to the interior side surface 76 of the corresponding side rail.

The construction of the chair and the arrangement or relationship of the pivots 38, 61, 67 and 69 is such that in the position of use of the chair on a horizontal surface as shown in FIGS. 1 and 2, the levers 64 and 66 extend in a forwardly and upwardly direction toward the seat back 12 with the lower transverse bar 48 engaging and bearing upon upper surface 75 of the rear leg portions 26 of the side rails 22 and 24.

Figure 7:
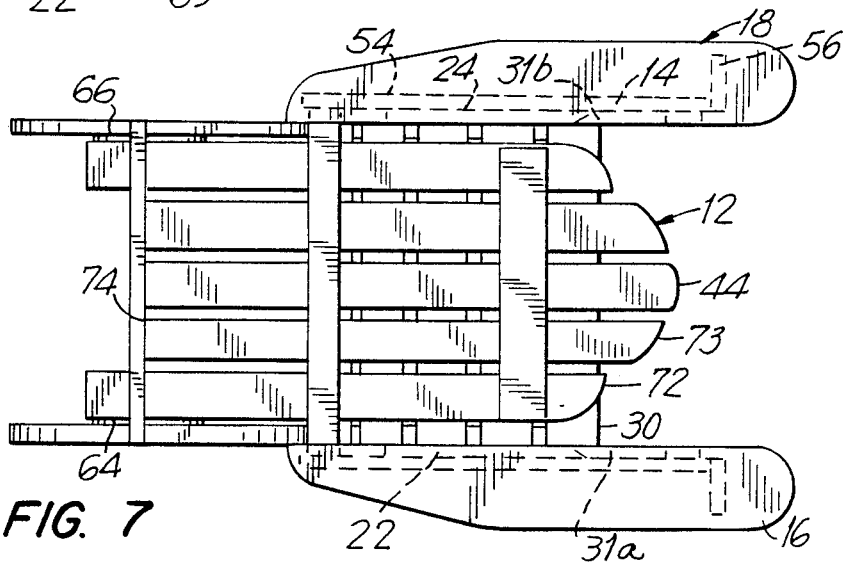
FIG. 7 is a top plan view of the foldable outdoor chair of FIG. 1 in its fully collapsed position.

In order to move the chair from its position of use to its fully collapsed position of FIGS. 6 and 7, the upper part 78 of the seat back assembly 12 may be grasped and a foot placed upon one of the rear leg portions 26 near the point 80 where it engages the ground or supporting surface. Then by lifting upwardly on the upper part 78 of the seat back, the seat back assembly 12 may be moved to an intermediate vertical position, during which time the chair will move towards a partially folded condition as seen in broken lines in FIG. 5. In this intermediate position, the front legs 34 and 36 are pivoted forwardly in the direction of arrow a with respect to the seat bottom and the elongated rib 54 of the arm rests as a result of a clockwise rotation being imparted to the first pivot point 67 of the lever. Additionally, the lower transverse bar 48 is removed remote from the upper surface 75 of the rear leg portions 26 of the side rails 22 and 24 and the bottom edge 82 of the arm rest rests against the curved camming surface 39 of the front legs. Furthermore, the rear surface 37 of each front leg is no longer in abutting engagement with the abutment members 31*a* and *b*.

As shown in FIG. 5, further pivoting about first pivot point 67 continues until the front legs 34 and 36 are pivoted generally parallel to the side rails 22 and 24 in a generally horizontal position and the front face 84 of the seat back engages the final transverse slat 86 of the seat bottom assembly. At this juncture, the front legs are restrained from further upward movement by abutting engagement with the bottom edge 88 of abutment members 31*a* and *b*. Furthermore, the seat back is positioned forwardly at about a 45 degree angle to the ground surface.

In order to move the chair to its fully collapsed position (FIGS. 6 and 7), a downward force in the direction of arrow b is applied to the rear face 90 of the seat back causing each lever 64 and 66 to pivot counterclockwise about their second pivot point 69 in the direction of arrow c until the front face 84 of the seat back abuts against the transverse slats 30 forming the seat bottom restraining further movement thereof. The levers continue to swing to the upwardly and rearwardly extending position of FIGS. 6 and 7 until the chair reaches its fully, collapsed position. In this collapsed position, the seat bottom and leg assembly 10 including the side rails 22 and 24, seat back assembly 12, front leg assembly 14, and the pair of arm rests 16 and 18 are all substantially horizontal and generally parallel to one another.

The process is reversed in order to move the chair from its fully, collapsed position to its open, usable position. An upward force is applied to the seat back assembly forcing the lever to pivot clockwise about its second pivot point 69 until the seat back is restrained from further upward movement by the last transverse slat 86 of the seat bottom at which position the seat back is at approximately a 45 degree angle to the ground surface. The seat back is then moved rearwardly such that the levers pivot counterclockwise about their first pivot point 67. The seat back is moved rearwardly until the lower transverse bar 48 is restrained from further movement by the top surface of the rear leg portion of the side rails. In this open position, the front legs are moved into a generally vertical position due to the pivoting of fastener connection 61. As such, the chair is ready for use.

Due to the construction of this foldable outdoor chair, no locking pin is necessary to retain the chair in its opened position of sue, as is needed by the prior art. In order to retain the chair in its use position, the chair has been constructed such that the outer slat members 72 of the seat back assembly extend below the final transverse slat 86 of the seat bottom, and the front of the lever 64 adjacent to the first pivot point 67 is positioned below the bottom of the transverse slats 30 when the chair is opened. In addition, in contrast to the prior art, the lever assembly is pivotally connected to the inner surface of one of the side rails in order to allow the front of the lever 64 to drop below the final transverse slat 86.

When one slides forward in the chair or puts pressure on the armrests 60 forward of the pivot point 38 (which is the natural position of the hands when rising from a chair), then the bottom portion of the seat back slats 72 and 73 exert pressure against the final transverse slat 86 and the chair is thereby locked in place. The only way to fold the chair is thus to stand to the side or in back of the chair and lift the seat back 44 upwardly until the front of the lever 64 and first pivot point 67 rise above the final transverse slat 86 of the seat bottom.

While the invention has been particularly shown and described with reference to a preferred embodiment, it will be readily appreciated by those of ordinary skill in the art that various changes and modifications may be made without departing from the spirit and scope of the invention. It is intended that the appended claims be interpreted as including the foregoing as well as various other such changes and modifications.

What is claimed is:

1. A foldable chair movable between a position of use and a collapsed position, comprising a combined seat bottom and rear leg assembly including a seat bottom and laterally spaced side rails; a seat back assembly including a seat back operatively connected to said side rails, said seat back assembly being in abutting engagement with said seat bottom in the use position; a front leg assembly including a pair of laterally spaced front legs operatively connected to said seat bottom and rear leg assembly; a pair of arm rests operatively connected to said front leg assembly and said seat back assembly; and a lever assembly to facilitate folding, including a pair of levers, each lever being pivotally connected to the seat back assembly at a first location, said first location defining a first pivot point which is positioned below said seat bottom in the use position of the chair, each said lever also being pivotally connected to a respective one of said side rails at a second location at an opposite end of each said lever from said first location, said second location defining a second pivot point which is positioned below the center axis of said side rails; said chair being movable between said use position and an intermediate position, wherein said seat back is initially raised upwardly and pushed forwardly such that said lever is pivoted clockwise about said first pivot point, and its collapsed position, wherein said lever is pivoted counterclockwise about said second pivot point.

2. The foldable chair of claim 1 wherein said side rails have a front seat bottom portion and a rear leg portion and a plurality of transverse slats connect the front seat bottom portions of said side rails to form said seat bottom.

3. The foldable chair of claim 2 wherein a transverse load bearing member connects the front ends of the front seat bottom portions of said side rails to retain said side rails in a generally parallel orientation with respect to one another.

4. The foldable chair of claim 2 and further including fastening means pivotally securing said front legs near their mid-points to the front ends of the seat bottom portions of said side rails.

5. The foldable chair of claim 2 wherein said seat back assembly includes a plurality of longitudinal slats which form said seat back and are connected near their upper end by an upper transverse bar and connected near their mid-points by an intermediate transverse bar and connected near their lower ends by a lower transverse bar.

6. The foldable chair of claim 5 wherein said lower transverse bar rests against said rear leg portion of said side rails to restrain further movement of said seat back assembly when the chair is in its use position.

7. The foldable chair of claim 1 wherein each said arm rest has an elongated rib secured to the underside thereof which extends lengthwise thereof from a point near the rear end of said arm rest to a point short of the front end thereof.

8. The foldable chair of claim 7 and further including means for pivoting the rear ends of the longitudinal ribs of said arm rest to said seat back assembly.

9. The foldable chair of claim 1 wherein each said front leg has a transverse plate at the upper end thereof capable of abuting engagement with the bottom surface of one of said arm rests to provide additional support for each said arm rest.

10. The foldable chair of claim 1 wherein in said use position, said front legs are restrained from further rearward movement by a pair of abutment members extending outwardly from said seat bottom.

11. The foldable chair of claim 1 wherein each said front leg includes a curved camming surface at a top corner thereof which aids said arm rest in pivoting with respect to said front legs to bring the chair to its closed, storing position.

12. The foldable chair of claim 1 wherein said intermediate position, said arm rests are restrained from further upwardly movement by a pair of abutment members extending outwardly from said seat bottom.

13. The foldable chair of claim 12 wherein said first pivot point is approximately one-half inch below said seat bottom.

14. The foldable chair of claim 1 wherein in said collapsed position, said seat bottom and leg assembly, seat back assembly, front leg assembly and a pair of arm rests are all substantially horizontal and generally parallel to one another.

15. A foldable chair movable between a position of use and a collapsed position, comprising a combined seat bottom and rear leg assembly including laterally spaced side rails and a seat bottom; a seat back assembly operatively connected to said side rails, said seat back assembly being in abutting engagement with said seat bottom in the use position; a front leg assembly operatively connected to said combined seat bottom and rear leg assembly; and a lever assembly to facilitate folding including a pair of levers, each lever being pivotally connected to the seat back assembly at a first location, said first location defining a first pivot point which is positioned below said seat bottom in the use position of the chair, each said lever also being pivotally connected to a respective one of said side rails at a second location at an opposed end of each said lever from said first location, said second location defining a second pivot point which is positioned below the center axis of said side rails.

16. The foldable chair of claim 15 wherein the chair is foldable when an upward force is applied to the seat back assembly to disengage said seat back from said side rails and subsequently a forward force is applied to said seat back such that a clockwise rotation is imparted to said first pivot point whereby said chair is moved to an intermediate position wherein said seat back is restrained from further forward movement by said seat bottom and then a downward force is applied to said seat back such that said levers are pivoted counterclockwise about said second pivot point until the chair is moved to its collapsed position.

17. A foldable chair movable between a position of use and a collapsed position, comprising a combined seat bottom and rear leg assembly including a seat bottom and laterally spaced side rails; a seat back assembly operatively connected to said rails and being in abutting engagement with said seat bottom in the use position; a front leg assembly operatively connected to said combined seat bottom and rear leg assembly; and a lever assembly to facilitate folding including a pair of levers, each lever being pivotally connected to the seat back assembly at a first location, said first location defining a first pivot point which is positioned below said seat bottom in the use position of the chair, each said lever also being pivotally connected to a respective one of said side rails at a second location at an opposed end of said lever from said first location, said second location defining a second pivot point which is positioned below the center axis of said side rails.

18. The foldable chair of claim 17 wherein the chair is foldable when an upward force is applied to the seat back assembly to disengage said seat back from said side rails and subsequently a forward force is applied to said seat back such that a clockwise rotation is imparted to said first pivot point whereby said chair is moved to an intermediate position wherein said seat back is restrained from further forward movement by said seat bottom and then a downward force is applied to said seat back such that said levers are pivoted counterclockwise about said second pivot point until the chair is moved to its collapsed position.

19. A foldable chair movable between a position of use and a collapsed position comprising a combined seat bottom and rear leg assembly; a seat back assembly; a front leg assembly; a pair or arm rests; and a lever assembly to facilitate folding; said combined seat bottom and rear leg assembly including laterally spaced side rails having front seat bottom portions and rear leg portions with a plurality of transverse slats connecting the front seat bottom portions of said side rails to form a seat bottom, and a transverse load bearing member connecting the front ends of the front seat bottom portions of said side rails to retain said side rails in a generally parallel orientation with respect to one another; said front leg assembly including laterally spaced front legs, fastening means pivotally mounting said front legs near their mid-points to the front ends of the seat bottom portions of said and subsequently a forward force is applied to said seat back such that a clockwise rotation is imparted to said first pivot point whereby said chair is moved to an intermediate position wherein said seat back is restrained from further forward movement by said seat bottom and then a downward force is applied to said seat back such that said levers are pivoted counterclockwise about said second pivot point until the chair is moved to its fully collapsed position.

* * * * *